US007399115B2

(12) United States Patent
Mavilla et al.

(10) Patent No.: US 7,399,115 B2
(45) Date of Patent: Jul. 15, 2008

(54) WATCHCASE INCLUDING A BACK COVER AND METHOD FOR FIXING A BACK COVER ON A WATCH CASE

(75) Inventors: Alain Mavilla, Biel (CH); Jean-Claude Monachon, Les Vieux-Prés (CH)

(73) Assignee: Omega S.A., Bienne (CH)

( * ) Notice: Subject to any disclaimer, the term of this patent is extended or adjusted under 35 U.S.C. 154(b) by 0 days.

(21) Appl. No.: 11/839,645

(22) Filed: Aug. 16, 2007

(65) Prior Publication Data

US 2008/0043577 A1 Feb. 21, 2008

(51) Int. Cl.
*G04B 37/00* (2006.01)

(52) U.S. Cl. ..... 368/309; 368/310

(58) Field of Classification Search ..... 368/33, 368/282, 297–301, 309–310
See application file for complete search history.

(56) References Cited

U.S. PATENT DOCUMENTS 372,558 A * 11/1887 Morrill ..... 368/310
4,298,973 A * 11/1981 Saito ..... 368/276
4,626,107 A * 12/1986 Nishikawa et al. ..... 368/276
2003/0016591 A1 1/2003 Meryrat et al.

FOREIGN PATENT DOCUMENTS

CH 333257 11/1958

OTHER PUBLICATIONS

European Search Report issued in corresponding application no. EP 06 11 9118, completed May 8, 2007.

* cited by examiner

*Primary Examiner*—Vit W Miska
(74) *Attorney, Agent, or Firm*—Griffin & Szipl, P.C.

(57) ABSTRACT

The present invention concerns a watchcase including a middle part (2) defining a housing (4) closed by a crystal and a back cover (6), the back cover (6) having a screw thread portion (14) in a first direction, characterised in that the middle part (2) includes a screw thread portion (16) in a second direction opposite to screw thread direction of the back cover (6), and in that said watchcase further includes an intermediate element (8) having a first screw thread portion (18) cooperating with the screw thread portion (14) of the back cover (6) and a second screw thread portion (20) cooperating with the screw thread portion (16) of the middle part (2).

13 Claims, 3 Drawing Sheets

WATCHCASE INCLUDING A BACK COVER AND METHOD FOR FIXING A BACK COVER ON A WATCH CASE

This application claims priority from European Patent Application No. 06119118.5 filed Aug. 17, 2006, the entire disclosure of which is incorporated herein by reference.

FIELD OF THE INVENTION

The present invention concerns a watchcase comprising a screwed on back cover the alignment of which can be adjusted with respect to a vertical 12 o'clock-6 o'clock axis. The present invention also concerns a method for securing a back cover onto a watchcase and more particularly, a method for aligning a back cover of a watchcase with respect to the watchcase.

BACKGROUND OF THE INVENTION

As the back cover of a watchcase is being screwed onto the middle part of the case, it frequently happens that, when the back cover is completely screwed on, one can see that the decorative markings or designs which may have been made for example by die stamping or engraving on the face of the back cover located on the side of the watch wearer's wrist, are not properly aligned with respect to the vertical 12 o'clock-6 o'clock axis of said watch, which, of course, is detrimental to the aesthetic appearance of said watch.

While this defective appearance may be tolerated for inexpensive watches, it constitutes a very inconvenient drawback for more expensive watches.

In order to overcome this drawback, the only solution known to date consists in coupling a back cover to a determined watchcase during machining, so as to ensure that, once completely screwed on, the back cover is perfectly aligned with the 12 o'clock-6 o'clock axis of the watch. This solution is however unsatisfactory since problems arise if the original back cover of the watch is ever lost or ruined and it becomes necessary to replace it with another back cover, which, one cannot be sure, will still be properly aligned with the vertical 12 o'clock-6 o'clock axis, once it is screwed onto the middle part.

The object of the present invention is to overcome this drawback in addition to others by proposing a system which, after screwing a back cover onto the middle part of a watchcase, enables the alignment of the back cover to be adjusted simply and efficiently with respect to the 12 o'clock-6 o'clock axis of the watch, so as to guarantee the proper disposition of the markings and other decorative designs which have been added to the face of the back cover of the watch oriented towards the side of the watch wearer's wrist.

SUMMARY OF THE INVENTION

The present invention thus concerns a watchcase comprising a middle part defining a housing closed by a crystal and a back cover, the back cover having a screw thread portion in a first direction, characterised in that the middle part comprises a screw thread portion in a second direction opposite to the back cover screw thread direction, said watchcase further comprising an intermediate element having a first screw thread portion cooperating with the back cover screw thread portion and a second screw thread portion cooperating with the middle part screw thread portion.

As a result of these features, when the back cover is screwed in abutment against the middle part and the screwing of the back cover is continued, the intermediary element which connect the back cover to the middle part can unscrew itself with respect to the back cover since the intermediary element is screwed on the middle part with a screw thread the direction of which is opposite to that of the screw thread which connect the intermediary to the back cover. The intermediary element can thus move vertically along the screw thread of the middle part, thereby allowing an easy alignment of the back cover when the back cover/intermediary element assembly is screwed in abutment against the middle part.

The present invention provides a device for securing a watchcase back cover which enables the back cover to be completely screwed onto the middle part of the watch so as to assure the sealing thereof and to avoid as far as possible any risk of losing said back cover, then, the back cover to be pivoted with respect to the middle part in order to make up for any lack of alignment of the markings or designs made on the visible face of said back cover with respect to the 12 o'clock-6 o'clock axis of the watch. It will be noted that this watchcase necessitates only few changes with respect to a classic watchcase and only one additional intermediary element.

The problems of the prior art are thus resolved. In particular, one is no longer obliged to machine the back covers and the middle parts in pairs with great precision in order to ensure that, during assembly, when a back cover is completely screwed onto the corresponding middle part, the back cover will be properly aligned with respect to 12 o'clock-6 o'clock axis of the watch. By reducing the requirements as to the precision with which the back covers and middle parts have to be machined, the present invention thus allows the manufacturing costs to be substantially reduced and limits the number of parts which have to be discarded because of machining defects, which, of course, has a favourable impact on the cost price of the finished watch.

According to another feature of the invention, the watchcase further includes means for increasing the friction couple between the intermediary element and the back cover, these means including preferably an elastic ring inserted between the intermediary element and the back cover. Owing to this increase of the friction couple, one avoids an unwanted unscrewing of the intermediary element with respect to the back cover upon screwing the back cover/intermediary element onto the middle part.

According to a preferred embodiment of the invention, the intermediary element includes a ring provided with an inner circular opening a section having a first diameter followed by a second section having a second diameter smaller that said first diameter. Further, the first screw thread portion is arranged in the wall delimiting its opening and the second screw thread portion is arranged in the surface of said section of greater diameter of the ring. The face of the back cover oriented towards the inside of the watchcase includes an annular groove one vertical wall of which including a screw thread intended to cooperate with said first screw thread portion of said ring, the width of the groove having dimensions for accommodating the section of smaller diameter of the ring. In this preferred embodiment, the section of smaller diameter of the ring includes an annular ring in which said elastic ring is disposed, said elastic ring being intended to cooperate in friction against the wall of the annular groove disposed opposite its wall including the screw thread.

According to an advantageous characteristic of the invention, the height of the section of greater diameter of the ring is smaller that the height of the section of smaller diameter of the ring and the depth of the annular groove of the back cover is equal or greater to the height of the section of smaller diameter of the ring.

The invention also concerns a method for aligning a back cover of a watchcase on a middle part characterized in that it includes the steps of:

providing a back cover having a screw thread portion in a first direction, providing a middle part of a watchcase including a screw thread portion in a second direction opposite to said first direction, providing an intermediary element having a first screw thread portion cooperating with the screw thread portion of the back cover and a second screw thread portion cooperating with the screw thread portion of the middle part, screwing said intermediary element onto the back cover using said first screw thread portion until its abuts against said back cover, screwing the back cover/intermediary element assembly onto the middle part using said second screw thread portion so that back cover abuts against said middle part, further rotating the back cover until the desired alignment with respect to the middle part, thereby causing the vertical displacement of the intermediary element with respect to the back cover.

BRIEF DESCRIPTION OF THE DRAWINGS

Other features and advantages of the present invention will appear more clearly from the following description of an example embodiment of the securing device according to the invention, this example being given purely by way of non-limiting illustration with reference to the annexed drawings, in which.

DETAILED DESCRIPTION OF THE ILLUSTRATIVE EMBODIMENTS

The present invention proceeds from the general inventive idea which consists in screwing a back cover not directly onto the middle part of a watchcase, but onto an intermediate element screwed respectively onto the back cover and the middle part via two screw threads having opposite pitches. Thus when the back cover is screwed in abutment against the middle part, the back cover can still be rotated with respect to the middle part of the watchcase in order to adjust its alignment for example with respect to the vertical 12 o'clock-6 o'clock axis of the watch. This is made possible owing to the displacement of the intermediary element along the screw thread of the middle part, displacement allowed via the arrangement of the two screw thread having pitches in opposite directions. As a result of these features, the present invention provides a timepiece whose middle part and back cover do not need to be machined with great precision, which allows the manufacturing costs to be reduced.

Figure 1:
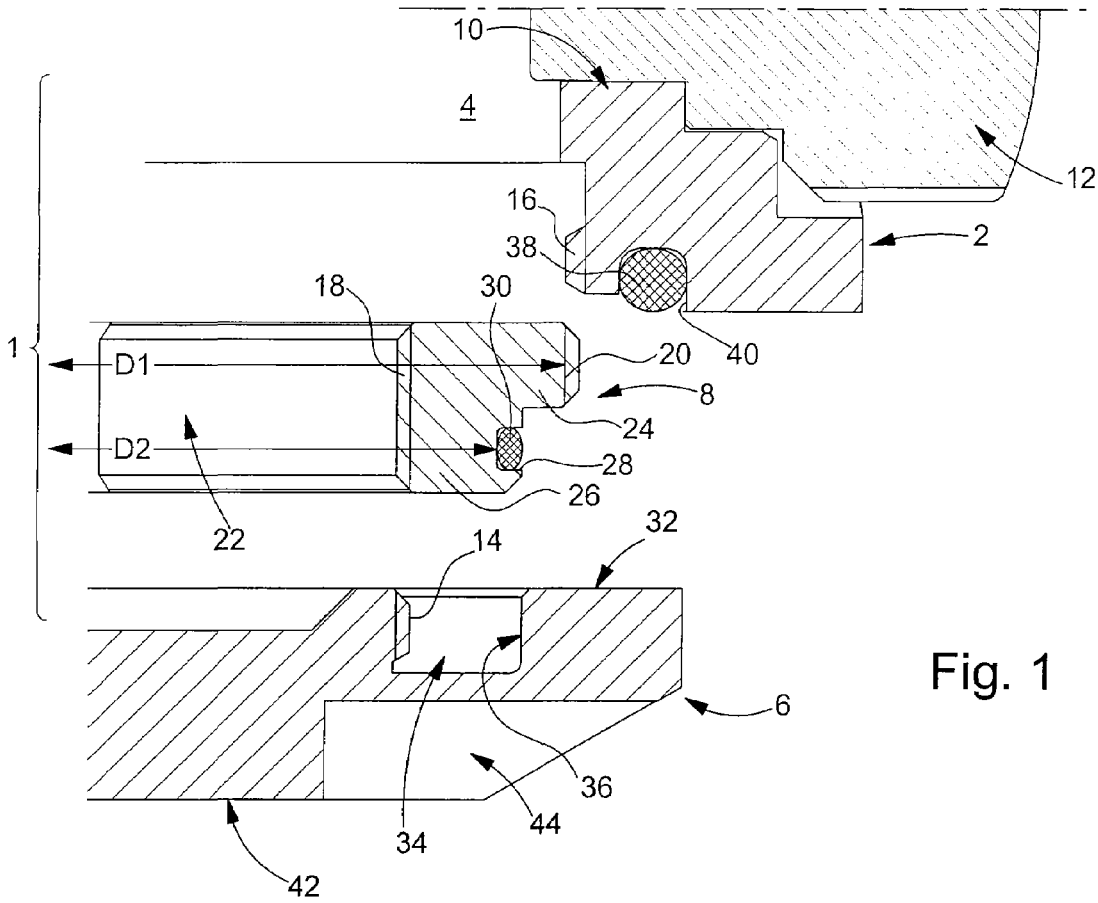
FIG. 1 is an exploded partial cross section of a watchcase of the invention.
Figure 2:
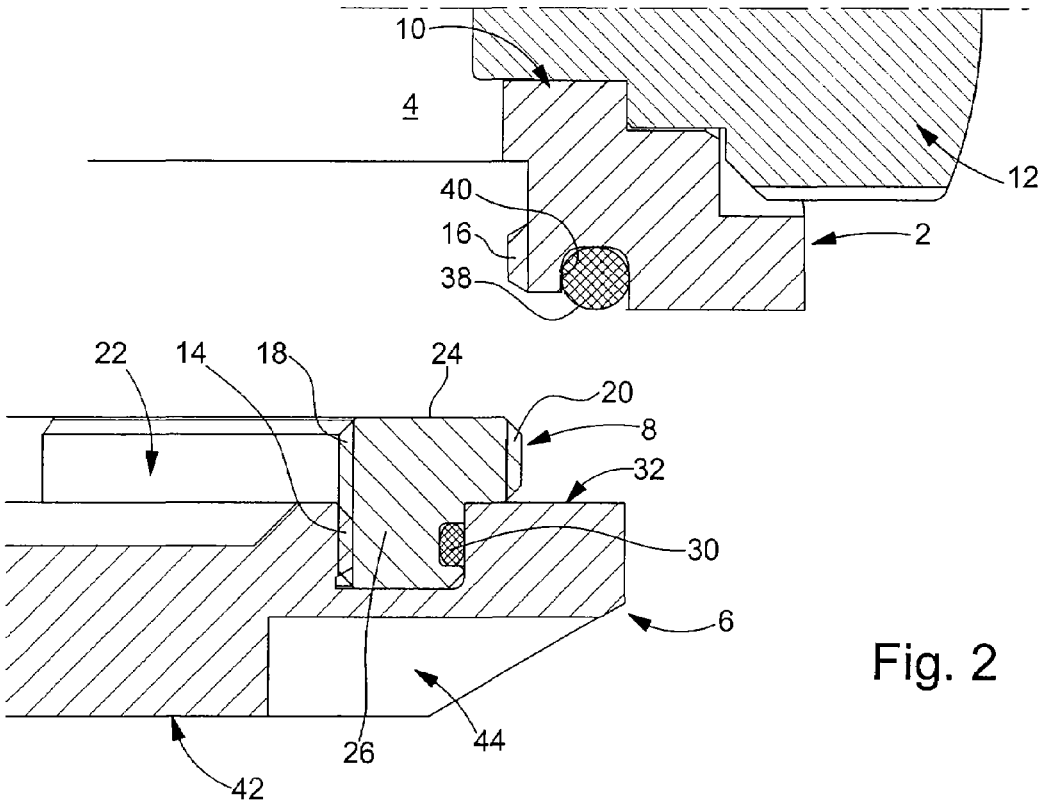
FIG. 2 is a cross-section made at the position of the snug of the metal element of a timepiece including an intermediate element for securing the back cover in accordance with the invention.

The watchcase according to the invention is shown in cross-section and in separate parts in FIG. 1. Designated as a whole by the general reference numeral 1, the watchcase includes a middle part 2 defining a housing 4 closed in a classical manner by a crystal (not shown) and a back cover 6 as well as an intermediary element 8 intended to be inserted between back cover 6 and middle part 2. Middle part 2 has a hole 10 for the passage of a stem (not shown) onto which a crown 12 is secured. Back cover 6 which in the example shown, is circular, has a screw thread portion 14 the pitch of which is oriented in a first direction while middle part 2 has screw thread portion 16 the pitch of which is oriented in a second direction opposite to that of back cover 6. Intermediary element 8 has a first screw thread portion 18 intended to cooperate with screw thread portion 14 of back cover 6 and second screw thread portion 20 intended to cooperate with screw thread portion 16 middle part 2. In the embodiment shown, intermediary element 8 has the form of a ring having a circular inner opening 22. The outer surface of ring 8 has steps and includes a cylindrical section 24 having a first diameter D1 followed by a cylindrical section 26 having a second diameter D2 smaller that said first diameter D1.

First screw thread portion 18 of ring 8 is made in the cylindrical wall of opening 22 thereof while second screw thread portion 20 is made in outer cylindrical portion 24 of large diameter of ring 8.

It will be noted that section 26 of ring 8 of smaller diameter includes at its outer surface an annular groove 28 in which an elastic ring 30 is disposed, the function of which will be described hereinafter.

In FIG. 1, one can also see that the face 32 of back cover 6 oriented towards the inside of the watchcase 1 includes an annular groove 34 one vertical wall of which includes screw thread 14 intended to cooperate with screw thread 18 of ring 8. The width of groove 34 is dimensioned to accommodate section 26 of smaller diameter of ring 8 and compress elastic ring 30 against wall 36 of groove 34 opposite screw thread 14 when ring 8 is screwed onto back cover 6. Thus, it will be understood that when elastic ring 30 is compressed against wall 36 of groove 34, the friction forces between ring 8 and back cover 6 increase and generate an increase in the friction couple between these two elements.

As an example, ring 8 can be made of steel. Elastic blocking element may be made of a natural or synthetic elastomer, or even of a thermoplastic material whose remanence set after compression is well suited to the requirements of the present invention.

Preferably, the height of portion 24 of larger diameter of ring 8 is smaller the height of portion 26 of smaller diameter of ring 8 and the depth of annular groove 34 of back cover 6 is equal or larger than the height of portion 26 of smaller diameter of ring 8.

It will be noted that an O-ring 38 is classically inserted in an annular groove 40 made in the bottom region of middle part 2 for assuring the water tightness between back cover 6 and middle part 2 and that the outer surface 42 of back cover 6 turned to the side of the wrist of the person wearing watch 26, includes notches 44 which are used for introducing the studs of a chuck key (not shown).

Figure 6:
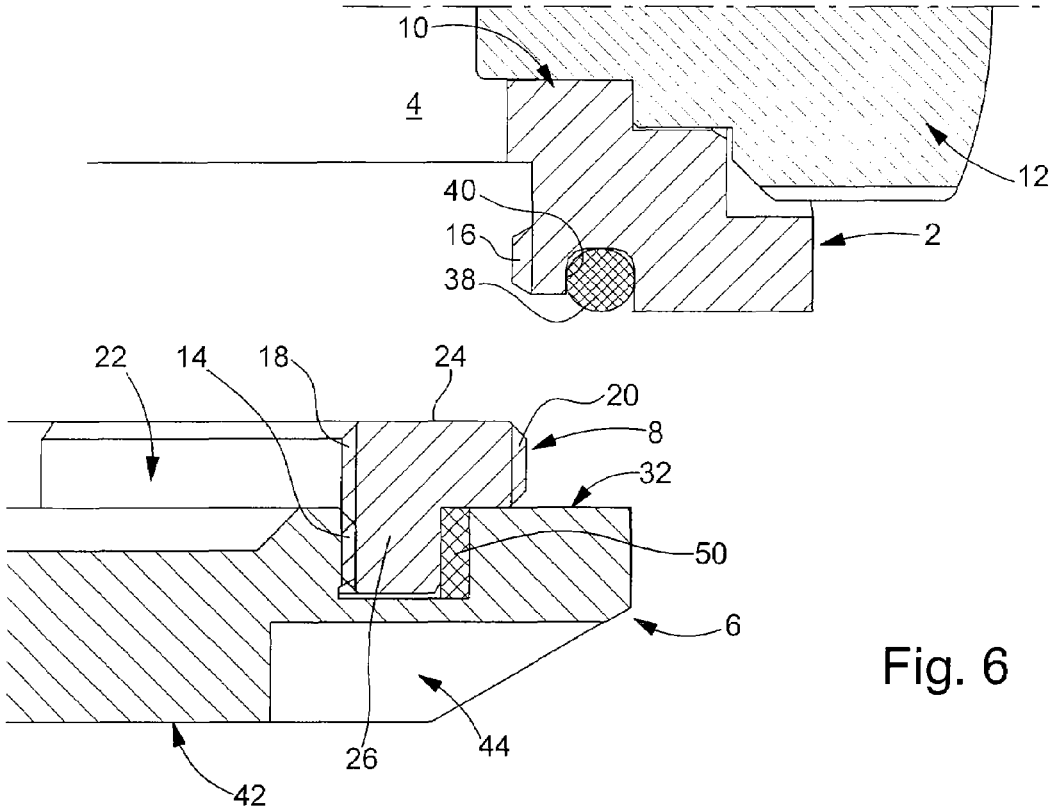
FIG. 6 is a similar view to that of FIG. 2 showing an alternative embodiment.

In FIG. 6 is shown an alternative embodiment of the watchcase according to the invention in which the elements identical to those already described hereinabove are designated by the same numeral references. This alternative embodiment differs from the watchcase described in connection with FIGS. 1 to 5 in that the means for increasing the friction couple between ring 8 and back cover 6 are formed a cylindrical sleeve 50 arranged on cylindrical portion D2 of smaller diameter of ring 8, the external diameter of sleeve 50 and the diameter defined by the inner wall 36 being adjusted to generate a friction when ring 8 is screwed onto back cover 6. The sleeve can typically be made of Asutane, marketed by the company Asulab SA, Marin, Switzerland.

Figure 7:
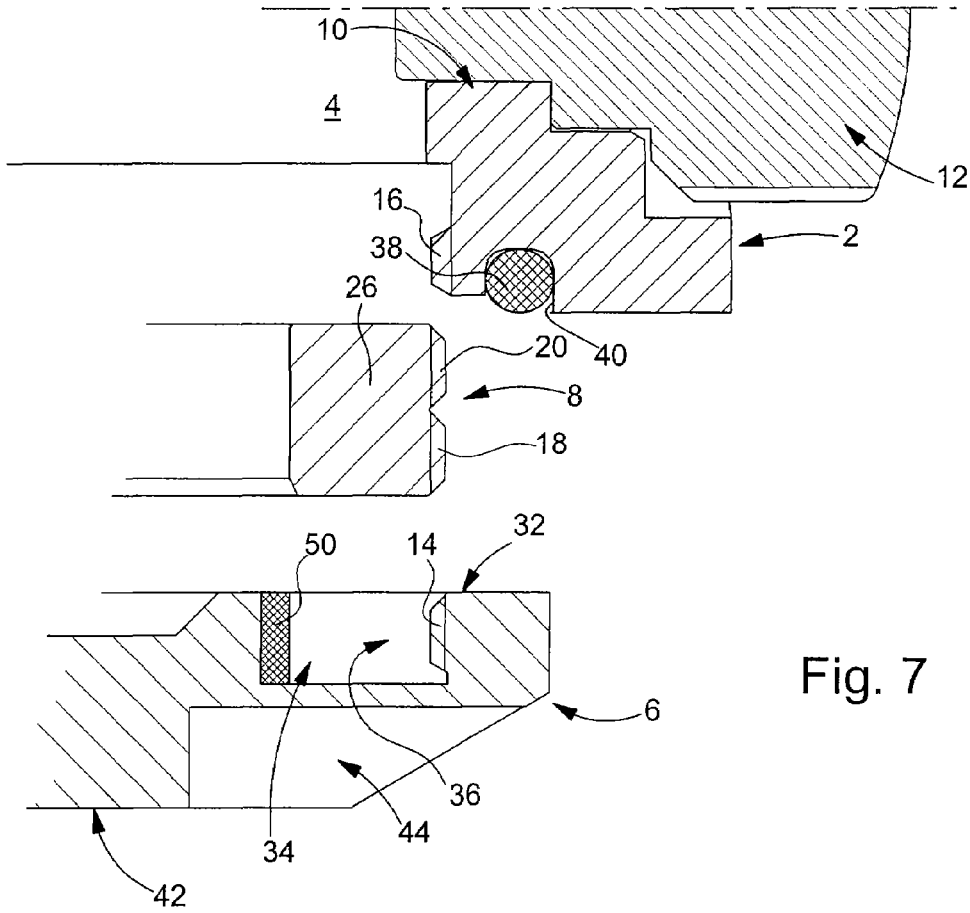
FIG. 7 is a similar view to that of FIG. 1 showing another embodiment of a watchcase according to the invention.

In FIG. 7 is shown another alternative embodiment of the watchcase according to the invention in which the elements identical to those already described hereinabove are designated by the same numeral references. This alternative embodiment differs from the watchcase described in connection with FIGS. 1 to 5 in that screw thread portions 18 and 20 of ring 8 are both made on the outer periphery of the ring and in particular on the same diameter. It will also be noted that screw thread portion 14 of the back cover is made in the wall opposite the groove, and that the means for increasing the friction couple between ring 8 and back cover 6 are formed of a sleeve 50 arranged in groove 34 between the wall of the groove opposite screw thread portion 14 and the inner cylindrical wall of ring 8.

The method for aligning back cover 6 of watchcase 1 on middle part 2 will now be described in connection with FIGS. 2 to 5.

In a first step, ring 8 is assembled to back cover 6 by screwing one of these elements on the other in a first direction of rotation until portion 24 of larger diameter abuts against face 32 of back cover 6. O-ring is thus compressed against wall 36 of groove 34 and generates a friction couple that is higher than the friction couple between ring 8 and middle part 2 when ring 8 will be subsequently screwed onto middle part 2.

Once the assembly formed of back cover 6 and ring 8 secured to each other by screwing formed, the assembly is the screwed, by inserting the studs of a chuck key in notches 44, onto middle part 2 via screw thread 20 which has a pitch in a direction opposite to that of the screw thread 18 and which cooperates with screw thread 16 of said middle part 2. The screwing of the assembly back cover 6-ring 8 stops when back cover 6 abuts against the lower surface of middle part 2.

Figure 3A:
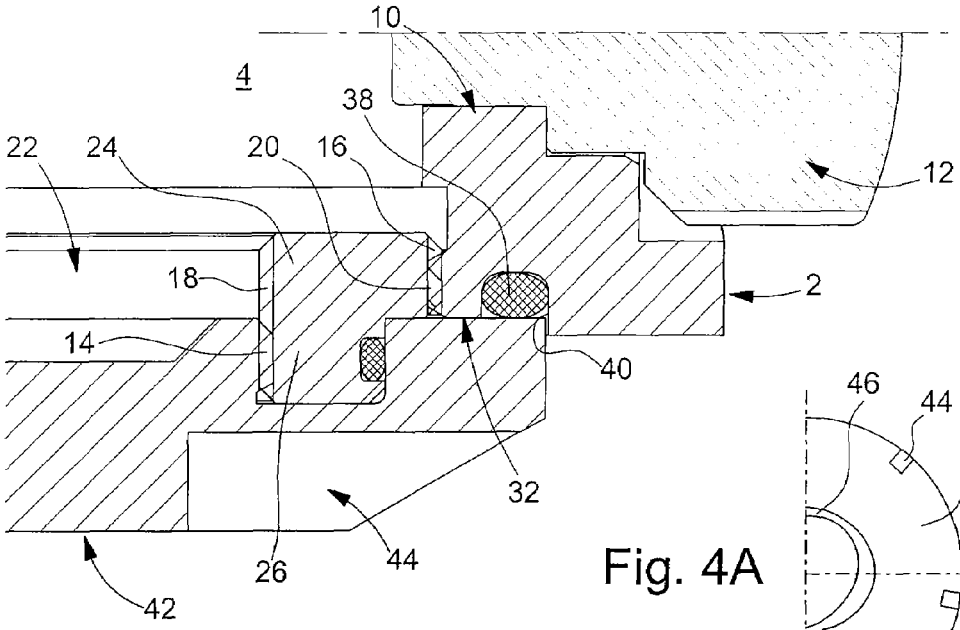
FIG. 3A is a partial cross-section of a watchcase according to the invention onto which the back cover is screwed in abutment against the middle case of the watch case.
Figure 4A:
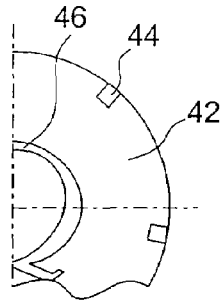
FIG. 4A is a partial cross-section of a watchcase according to the invention in which the back cover has been aligned in a desired position after having been screwed in abutment against the middle case of the watch case.
Figure 3B:
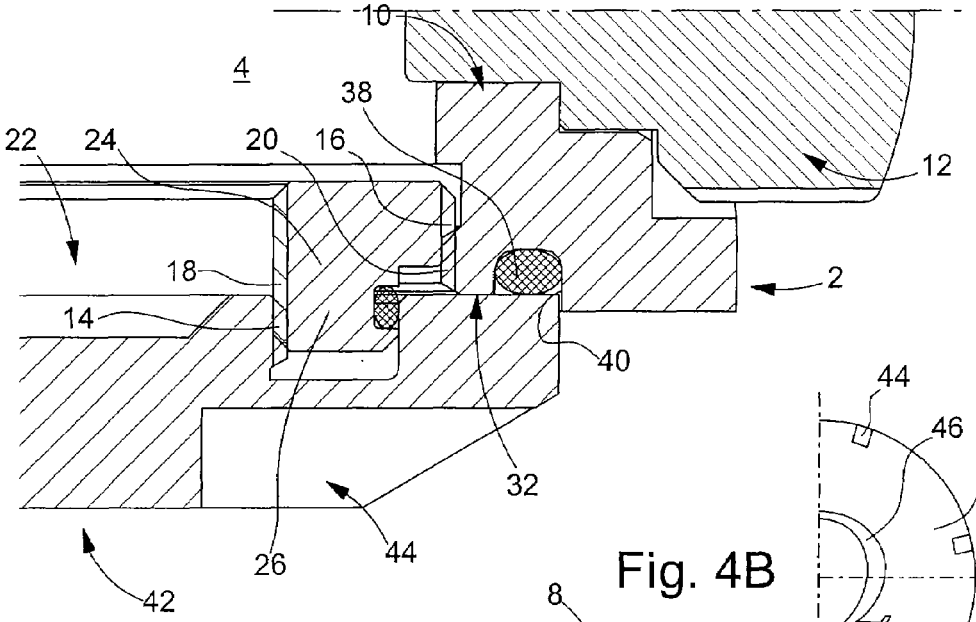
FIG. 3B is a partial view of the visible face of the back cover of the watch case in a non aligned position.
Figure 4B:
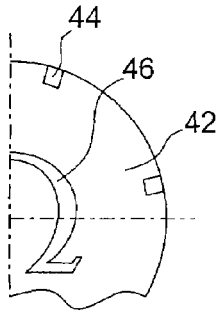
FIG. 4B is a similar view to that of FIG. 3A, the back cover being here in an aligned position.
Figure 5:
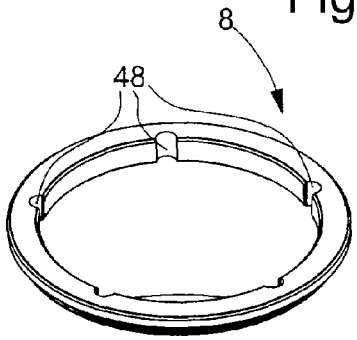
FIG. 5 is a perspective view of the intermediary element.

Once screwed on, it can be seen in FIG. 3A that back cover 6 onto which a design 46 (in this case, it is the capital Greek letter omega) has been added, is totally out of alignment with respect to the vertical 12 o'clock-6 o'clock axis of watch. The problem thus consists in correcting this design 46 so that it is properly aligned and that the aesthetic appearance of watch is thereby improved. For that purpose, once back cover 6 has been screwed in abutment against intermediary element 8, one continues screwing back cover 6 again using the chuck key. At that time, as back cover 6 abuts against middle part 2, and as ring 8 is screwed onto back cover 6 via a screw thread 18 the pitch of which has direction opposite to that of screw thread 20 via which ring 8 is screwed onto middle part 2, back cover 6 can be rotated to align it in a desired manner, thereby causing a vertical displacement of ring 8 along screw thread 16 of middle part 2 (FIG. 4A).

The problem now arises as to how to unscrew back cover 6 when this is necessary. In order to do this, one continues to use the chuck key to unscrew this assembly until the assembly back cover 6-ring 8 is totally unscrewed from middle part 2, the friction between back cover 6 and ring 8 holding the assembly together. Thereafter, using the same chuck key or any other appropriate tool, one unscrews ring 8 from back cover 6. For that purpose, ring 8 includes notches 48 for accommodating the studs of the tool (see FIG. 5). In an alternative manner, one can continue to screw back cover 6 in order to cause the displacement of ring 8 towards the inside of the middle part along screw thread portion 16 until the ring separated from back cover 6.

The method described above can be applied mutatis mutandis to the embodiments of the watchcase of the invention shown in FIGS. 6 and 7.

As it will have been understood from the above, the present invention can be applied to any type of watch pieces having a back cover screwed onto the middle part and requires, to be implemented, minor changes only, which concerns essentially the shape of the middle part 2 in its lower part where the junction with the back cover 6 is made.

It goes without saying that the invention is not limited to the embodiment which has just been described and that various simple modifications and variants can be envisaged without departing from the scope of the invention. In particular, one could envisage that the ring is screwed on the back cover via a screw thread provided on the outer surface of its cylindrical portion of larger diameter and the ring is screwed on the middle part via a screw thread provided on the inner surface of its cylindrical portion of smaller diameter.

What is claimed is:

1. A watchcase including a middle part (2) defining a housing (4) closed by a crystal and a back cover (6), the back cover (6) having a screw thread portion (14) in a first direction, wherein the middle part (2) includes a screw thread portion (16) in a second direction opposite to screw thread direction of the back cover (6), and in that said watchcase further includes an intermediate element (8) having a first screw thread portion (18) cooperating with the screw thread portion (14) of the back cover (6) and a second screw thread portion (20) cooperating with the screw thread portion (16) of the middle part (2).

2. The watchcase according to claim 1, wherein said watchcase further includes means for increasing the friction couple between the intermediate element (8) and the back cover (6).

3. The watchcase according to claim 2, wherein the intermediate element (8) includes a ring provided with an inner circular opening (22), a section (24) having a first diameter (D1) followed by a second section (26) having a second diameter (D2) smaller that said first diameter (D1), wherein said first screw thread portion (18) is arranged in the wall delimiting its opening (22) and wherein said second screw thread portion (20) is arranged in the surface of said section (24) of greater diameter of the ring.

4. The watchcase according to claim 2, wherein said means for increasing the friction couple include an elastic ring or sleeve (30) inserted between the intermediate element (8) and the back cover (6).

5. The watchcase according to claim 1, wherein the intermediate element (8) includes a ring provided with an inner circular opening (22), a section (24) having a first diameter (D1) followed by a second section (26) having a second diameter (D2) smaller that said first diameter (D1), wherein said first screw thread portion (18) is arranged in the wall delimiting its opening (22) and wherein said second screw thread portion (20) is arranged in the surface of said section (24) of greater diameter of the ring.

6. The watchcase according to claim 4, wherein the intermediate element (8) includes a ring provided with an inner circular opening (22), a section (24) having a first diameter (D1) followed by a second section (26) having a second diameter (D2) smaller that said first diameter (D1), wherein said first screw thread portion (18) is arranged in the wall delimiting its opening (22) and wherein said second screw thread portion (20) is arranged in the surface of said section (24) of greater diameter of the ring.

7. The watchcase according to claim 5, wherein the face (32) of the back cover (6) oriented towards the inside of the watchcase (1) includes an annular groove (34), one vertical wall of which (36) includes a screw thread (14) intended to cooperate with said first screw thread portion (18) of said ring (8), the width of the groove (34) having dimensions for accommodating the section (26) of smaller diameter of the ring (8).

8. The watchcase according to claim 6, wherein the section (26) of smaller diameter of the ring (8) includes an annular ring (28) in which said elastic ring (30) is disposed.

9. The watchcase according to claim 5, wherein the height of the section (24) of greater diameter of the ring (8) is smaller than the height of the section (26) of smaller diameter of the ring (8).

10. The watchcase according to claim 5, wherein the depth of the annular groove (34) of the back cover (6) is equal or greater to the height of the section (26) of smaller diameter of the ring (8).

11. The watchcase according to claim 1, wherein the intermediate element (8) includes a ring provided with an inner circular opening (22) and an external cylindrical surface including successively the first screw thread portion (18) and the second screw thread portion (20).

12. The watchcase according to claim 11, wherein the face (32) of the back cover (6) oriented towards the inside of the watchcase (1) includes an annular groove (34), one vertical wall of which (36) includes a screw thread (14) intended to cooperate with said first screw thread portion (18) of said ring (8), the width of the groove (34) having dimensions for accommodating the ring (8), a sleeve being inserted between the ring and the vertical wall opposite to the wall including said screw thread (14).

13. A method for aligning a back cover (6) of a watchcase (1) on a middle part (2) including the steps of;

providing a back cover (6) having a screw thread portion (14) in a first direction, providing a middle part (2) of a watchcase including a screw thread portion (16) in a second direction opposite to said first direction, providing an intermediate element (8) having a first screw thread portion (18) cooperating with the screw thread portion (14) of the back cover (6) and a second screw thread portion (20) cooperating with the screw thread portion (16) of the middle part (2), screwing said intermediate element (8) onto the back cover (6) using said first screw thread portion (18) until its abuts against said back cover, screwing the back cover (6)-intermediate element (8) assembly onto the middle part (2) using said second screw thread portion (20) so that back cover (6) abuts against said middle part (2), further rotating the back (6) until the desired alignment with respect to the middle part (2), thereby causing the vertical displacement of the intermediate element (8) with respect to the back cover (6).

* * * * *

UNITED STATES PATENT AND TRADEMARK OFFICE

CERTIFICATE OF CORRECTION

PATENT NO. : 7,399,115 B2
APPLICATION NO. : 11/839645
DATED : July 15, 2008
INVENTOR(S) : Alain Mavilla et al.

It is certified that error appears in the above-identified patent and that said Letters Patent is hereby corrected as shown below:

On the Title Page, the Assignee should read:

(73) Assignee: Omega S.A., Bienne 4 (CH)

On the Title Page, the following information should appear:

Foreign Application Priority Data

August 17, 2006 (EP) ……...06119118.5

Signed and Sealed this

Twenty-fifth Day of November, 2008

JON W. DUDAS
*Director of the United States Patent and Trademark Office*